US009719230B2

(12) United States Patent
Showley

(10) Patent No.: US 9,719,230 B2
(45) Date of Patent: Aug. 1, 2017

(54) MOBILE VACUUM WITH REMOTE DEBRIS TANK

(75) Inventor: Brian Showley, Leesburg, FL (US)

(73) Assignee: VAC-TRON EQUIPMENT, LLC, Okahumpka, FL (US)

( * ) Notice: Subject to any disclaimer, the term of this patent is extended or adjusted under 35 U.S.C. 154(b) by 1242 days.

(21) Appl. No.: 12/984,590

(22) Filed: Jan. 4, 2011

(65) Prior Publication Data

US 2011/0296646 A1 Dec. 8, 2011

Related U.S. Application Data

(60) Provisional application No. 61/292,006, filed on Jan. 4, 2010.

(51) Int. Cl.

| | |
|---|---|
| ***E01H 1/08*** | (2006.01) |
| ***E02F 3/88*** | (2006.01) |
| ***E02F 3/90*** | (2006.01) |

(52) U.S. Cl.

CPC ..... *E02F 3/8825* (2013.01); *E02F 3/88* (2013.01); *E02F 3/90* (2013.01); *E01H 1/0809* (2013.01); *E01H 1/0863* (2013.01)

(58) Field of Classification Search

CPC ..... E02F 3/88; E02F 3/8816; E02F 3/8825; E02F 3/90; E01H 1/08; E01H 1/0809; E01H 1/0836; E01H 1/0863; B60P 3/2215

USPC ..... 15/340.1–340.4

See application file for complete search history.

(56) References Cited

U.S. PATENT DOCUMENTS

| | | | | |
|---|---|---|---|---|
| 3,990,125 | A * | 11/1976 | Saiia | 15/83 |
| 4,121,915 | A * | 10/1978 | Anderson | A47L 9/182 15/340.1 |
| 4,199,837 | A * | 4/1980 | Fisco, Jr. | 15/302 |
| 4,218,226 | A * | 8/1980 | Boozer | 96/414 |
| 4,922,571 | A * | 5/1990 | Driear | 15/302 |
| 5,030,259 | A * | 7/1991 | Bryant | B01D 50/002 15/340.1 |
| 5,141,528 | A * | 8/1992 | Boczkiewicz | B65D 88/30 15/340.1 |
| 5,212,891 | A | 5/1993 | Schuermann et al. | |
| 6,385,867 | B1 | 5/2002 | Slabach et al. | |
| 6,453,584 | B1 | 9/2002 | Buckner | |
| 6,604,304 | B1 | 8/2003 | Slabach et al. | |
| 6,615,849 | B1 | 9/2003 | Gilman et al. | |
| 6,988,568 | B2 | 1/2006 | Buckner | |
| 7,503,134 | B2 | 3/2009 | Buckner | |
| 7,604,023 | B2 | 10/2009 | Buckner et al. | |

(Continued)

OTHER PUBLICATIONS

Brochure for FlowMaster 350 Series, 2007.

(Continued)

*Primary Examiner* — Bryan R Muller

(74) *Attorney, Agent, or Firm* — Matthew G. McKinney, Esq.; Allen, Dyer, Doppelt + Gilchrist, P.A.

(57) ABSTRACT

A mobile vacuum system includes a mobile support frame, a vacuum source connected to selectively vacuum materials into a primary collection tank and a secondary collection tank. The primary collection tank is mounted on the frame, while the secondary collection tank is connected to either the frame of the primary collection tank by a boom. The boom, which can be in the form of an articulated arm, allows the secondary collection tank to be moved through a wide range of motion relative to the frame, e.g., for dumping debris from the secondary tank.

4 Claims, 12 Drawing Sheets

(56) References Cited

U.S. PATENT DOCUMENTS

| | | | | |
|---|---|---|---|---|
| 7,644,523 | B2 | 1/2010 | Buckner | |
| 7,735,186 | B1 * | 6/2010 | Vogel | 15/320 |
| 7,837,050 | B2 | 11/2010 | Maybury, Jr. | |
| 2005/0166350 | A1 * | 8/2005 | Buckner | 15/312.2 |
| 2006/0032012 | A1 | 2/2006 | Buckner | |
| 2006/0236499 | A1 * | 10/2006 | Cappellotto | 15/340.1 |
| 2008/0040945 | A1 | 2/2008 | Buckner | |

OTHER PUBLICATIONS

Webpage for Vacmasters System 4000, http://www.vacmasters.com/air4000.htm, Vacmasters, Arvada, CO.

J. Griffin, "Bess Testlab Finds Many Uses for Air Vac Systems," "Rehabilitation Selection Guide," Underground Construction, Jul. 2005.

* cited by examiner

MOBILE VACUUM WITH REMOTE DEBRIS TANK

RELATED APPLICATIONS

This application claims benefit of U.S. Provisional Application No. 61/292,006, which was filed on Jan. 4, 2010 and is entitled "Mobile Vacuum With Remote Debris Tank." The entire disclosure of the aforementioned provisional application is incorporated herein by reference.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Portable vacuum systems can be used to remove a variety of wet and dry material. Some applications include storm drain clean out, locating underground utilities, cleanup at treatment plants, vacuuming out retention ponds, cleaning out of lateral lines, excavation of small rocks and dry sand, mud removal, manhole clean out, meter box cleaning, saw mill clean up, and emergency road spills. Such systems are typically either mounted on a truck or a trailer, to facilitate their transportation. Examples of such systems are disclosed in the following patents and published applications, the disclosures of which are hereby incorporated by reference: U.S. Pat. No. 6,385,867 to Slabach et al. for "System For Vacuum Excavation;" U.S. Pat. No. 6,453,584 to Buckner for "Continuous Vacuum, Separator, Dispensing System;" U.S. Pat. No. 6,604,304 to Slabach et al. for "Dual Mode Evacuation System For Vacuum Excavator;" U.S. Pat. No. 6,988,568 to Buckner for "Vacuum Boring and Mud Recovery System;" U.S. Pat. No. 7,503,134 to Buckner for "Fixed Slope Vacuum Boring and Mud Recovery System;" U.S. Pat. No. 7,604,023 to Buckner et al. for "Utility Valve Access and Performance Evaluation Means," U.S. Pat. No. 7,644,523 to Buckner for "Mobile Vacuum Boring and Excavation Method;" U.S. Pat. No. 7,837,050 to Maybury, Jr. for "Collection Tank;" and U.S. Patent Application Pub. No. 2006/0032012 to Lynn Buckner for "Mobile Vacuum Boring and Mud Recovery Method Having An Articulated Vacuum Conduit Boom with Digging Bucket."

These vacuum systems are often used in connection with excavation systems that use a stream of fluids, usually air or water, to dislodge earth. The vacuum is then used to draw water with solids from the excavation into a storage tank.

In some applications, it is desirable to be able to return the material from the storage tank to the hole, for example after the underground utility has been serviced. It may also desirable to be able to separate wet material from the dry material. One system that provides for separate storage of wet and dry material is the Vacmasters System 4000 as sold by Vacmasters of Arvada, Colo. The System 4000 includes a primary storage tank and a smaller secondary storage tank. Both tanks are fixedly mounted on the body of a truck. The secondary tank can be used, for example, to store dry material in potholing applications. In order to return the dry material to the hole with this design, it is necessary to maneuver the truck to position the tank over the hole, or alternatively to manually move the material, e.g., using a wheelbarrow, from the storage tank to the hole.

Figure 1:
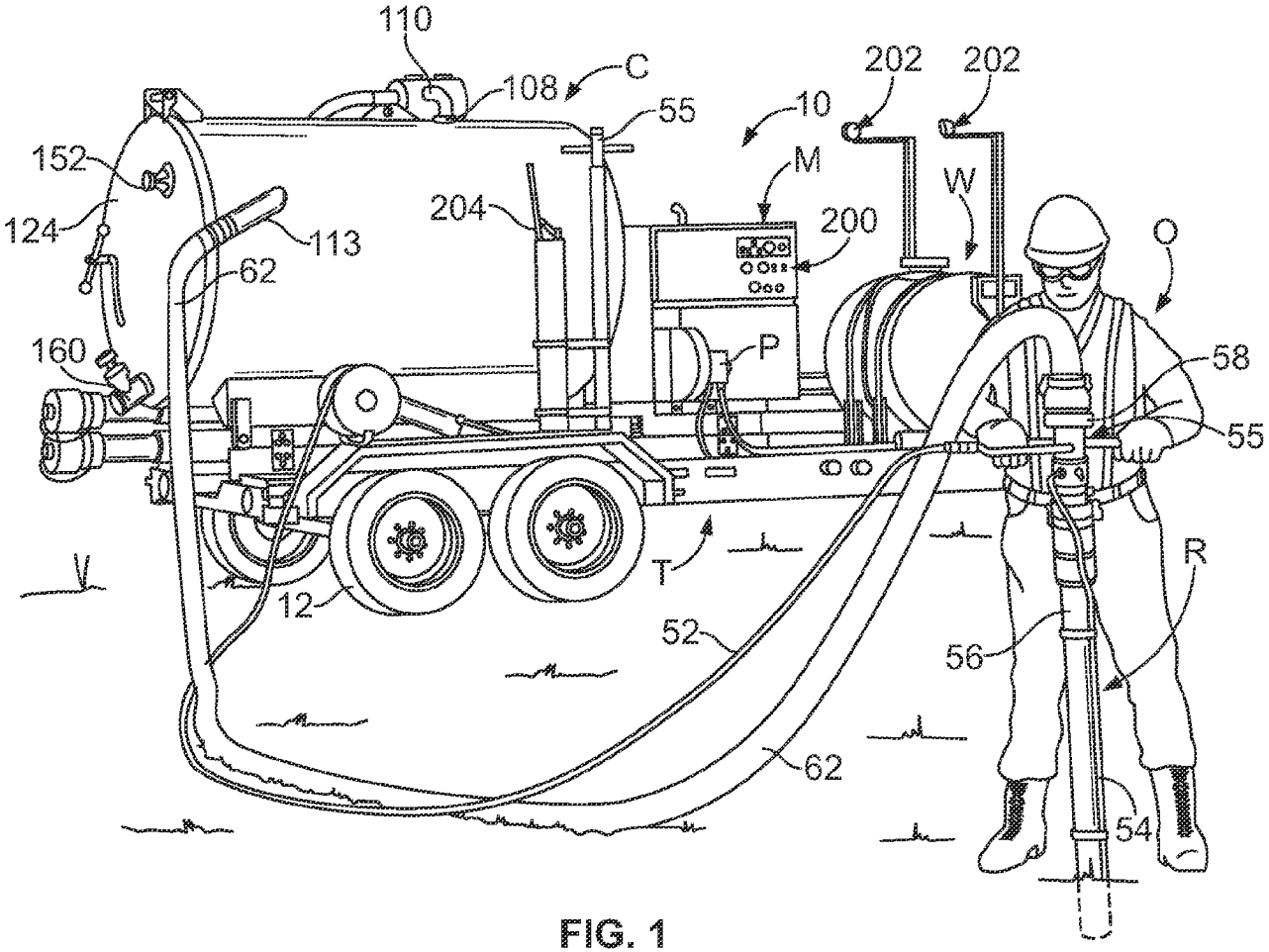
FIG. 1 Prior Art
FIG. 1 is a perspective view of a prior art mobile vacuum and reduction system.
Figure 2:
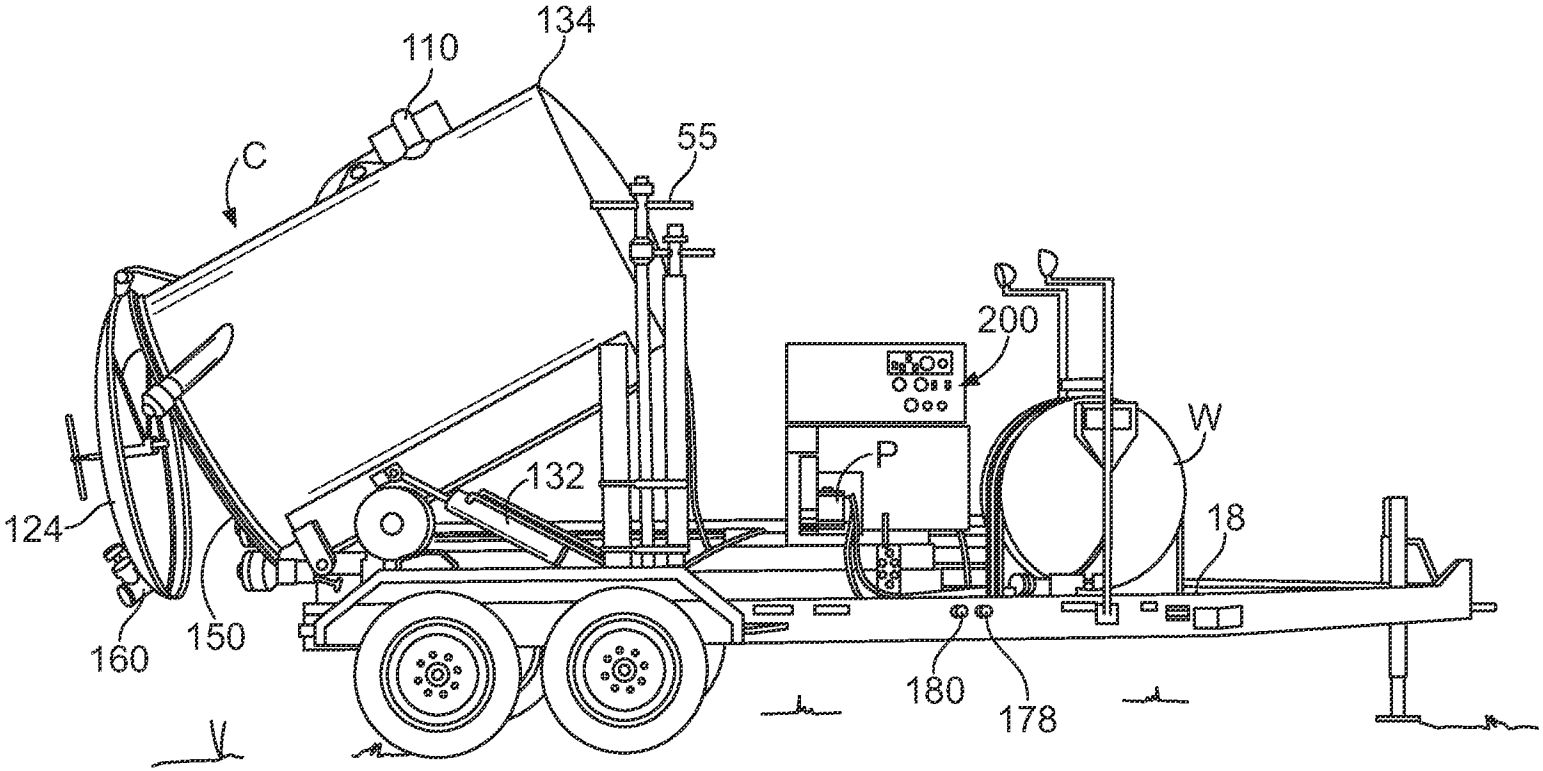
FIG. 2 Prior Art
FIG. 2 is a side elevation view of the system of FIG. 1, illustrating the tank in its inclined (dumping) position.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

Figure 3:
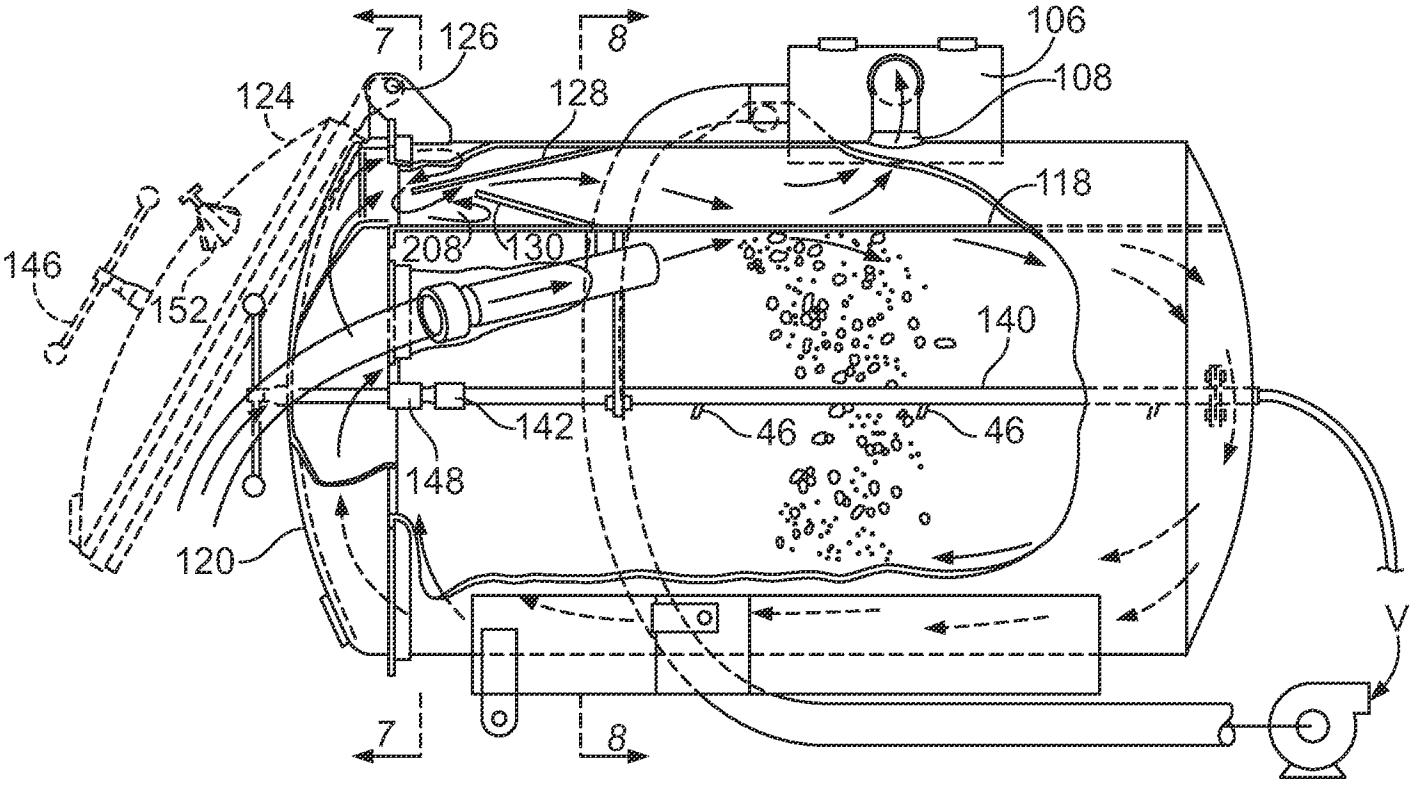
FIG. 3 Prior Art
FIG. 3 is a side elevation view illustrating operation of the vacuum tank of the system of FIG. 1.

By way of background, FIGS. 1-4 illustrate a typical prior art mobile vacuum and soil reduction system, as is described in U.S. Pat. No. 6,615,849 to Gilman et al. ("849 patent"), the disclosure of which is hereby incorporated by reference. Briefly, the vacuum and reduction system 10 includes a trailer T which carries the various components of the system, including a water tank W, a motor M and a collection tank C. The water reservoir W is connected to a water pump P, which is driven by the motor M. Motor M also drives a vacuum pump V (FIGS. 3 and 4) and a hydraulic pump 168 (FIG. 3). Vacuum pump V and water pump P can be connected to a reduction tool R, which is the actual remediation tool worked by an operator O (FIG. 1). The vacuum pump V is connected to an exhaust port of the collection tank for drawing a vacuum through the tank C.

Figure 4:
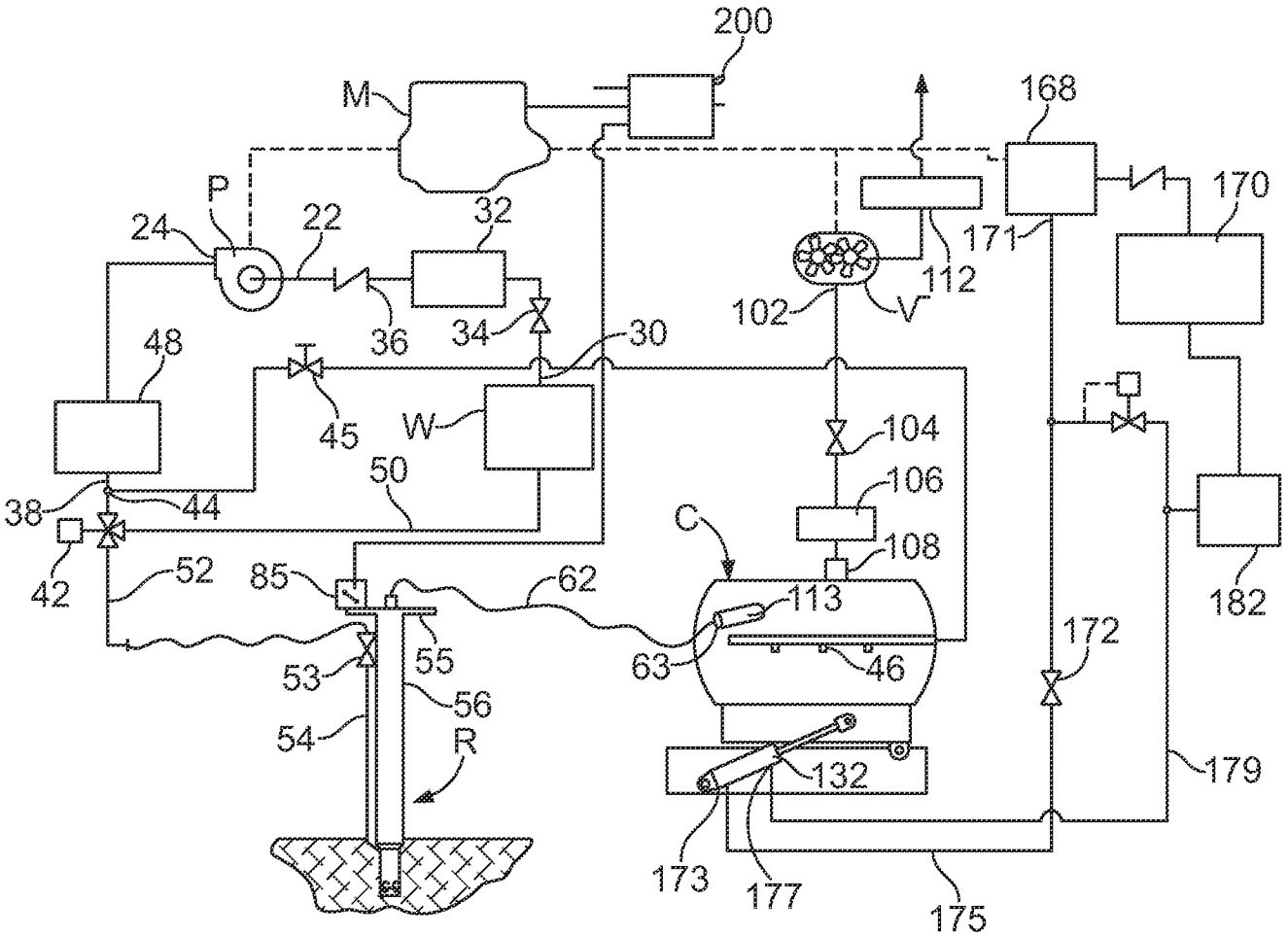
FIG. 4 is a schematic illustration of the hydraulic, water, and vacuum systems of the system of FIG. 1.

As shown in FIG. 4, an outlet 30 of water tank W is connected to the low pressure side 22 of water pump P through a valve 34, a strainer 32 and a check valve 34. Water is discharged from the high pressure side 24 of water pump P through a filter 48 and pressure relief and bypass valve 42. A tee 44 is disposed between the high pressure outlet 24 of the water pump and the valve 42. The tee 44 is connected to the clean out nozzles 46 in the tank C through a valve 45.

A return line 50 is connected to valve 42 and to water tank W for returning water at a low pressure to tank W when a predetermined pressure is exceeded in the valve 42. This causes water to fully bypass to tank W, or in the event pressurized water, or other fluid as may be needed, is not yet up to a desired pressure, such fluid is returned to the tank W until the predetermined pressure is achieved in the valve 42.

A hose 52 is connected to the output of the valve 42 which leads to the reduction tool R. A control valve 53 at the handle 55 of the reduction tool is provided for allowing the operator to selectively actuate the valve 53 to deliver water to a conduit 54 (FIGS. 1 and 4) attached to the exterior of an elongated pipe 56 which extends the length of the reduction tool.

The reduction tool R includes the handle 55 noted above for grasping by the operator during use of the tool. The handle includes a connector 58 for connecting a central vacuum passage (not shown), which extends the length of the tool R, to a vacuum source. This is accomplished by attaching one end of a vacuum hose 62 to the handle and the other end of the hose 62 to the collection tank C at a collection tank inlet 113 (FIG. 1). Further details of the reduction tool are provided in the 849 patent.

The intake 102 of the vacuum pump is connected to a port 108 on the collection tank C for drawing a vacuum through the tank. A vacuum relief device 104 can be interconnected between the vacuum pump V and the collection tank C for controlling maximum negative pressure of vacuum pulled by the pump. A filter 106 can be connected between the relief device 104 and the exhaust outlet 108 of the collection tank. The exhaust side of the vacuum pump V is vented to atmosphere though a silencer 112.

The vacuum pump V produces a vacuum in the collection tank, which in turn draws a vacuum through an inlet 113 of collection tank. The inlet can be connected to the reduction tool R through the hose 62. A valve 63 is provided for opening and closing the inlet 113. When the valve 63 is open, a vacuum is drawn though the reduction tool R for vacuuming soil, water, or other materials through the reduction tool and into the collection tank C.

The collection tank C may include a baffle system to separate soil and other material from the soil, water, and other material from the air flow received from the reduction tool. The details of one such baffle system are provided in the 849 patent. Briefly, as shown in FIG. 3, air drawn in through the inlet 113 of the collection tank is first drawn upwardly, and dirt, rocks, and other debris in the flow hit a first baffle 118 and fall to the bottom portion of the collection tank. Smaller particles continue to be carried by the flow towards the front of the tank, and downwardly across the bottom of the tank back towards the rear 120 of the tank. Debris that does not fall out by this point may be carried upwardly, but may also impact a second baffle (not shown) provided on the discharge door 124 of the tank. The vacuum air stream, after contacting the second baffle 122 continues upwardly and impacts and is deflected by an third baffle 128 and then further impacts and is further deflected by a fourth baffle 130, each time causing additional particles or other materials constrained in the air flow to become trapped at these baffles. Finally, the vacuum air flow exits the outlet 108 of the collection tank and passes through the filter 106 and on to the vacuum pump, as discussed above.

The tank C includes a discharge door 124 that can be opened to allow the tank C to be emptied. Hydraulic cylinders 132 (FIG. 2) are provided for controllably tilting the forward end 134 of the tank upwardly. The discharge door 124 is connected to the top of the tank C by a hinge 126 to allow the bottom of the door to swing open when the tank is inclined, thereby allowing the contents of the tank to be discharged.

The door 124 of the collection tank also includes a gate valve 160 for draining the liquid portion of the slurry without requiring the door 124 to be open. The gate valve 160 may also be used to introduce air into the tank in order to reduce the vacuum within the tank by a sufficient degree such that the door may be opened.

The collection tank C can also include a cleanout system as described in the 849 patent. In this regard, a nozzle tube 140 extends along the length of the tank C and includes a plurality of fan-shaped nozzles 46 for directing high pressure water about the tank. The nozzles 46 are actuated by turning the valve 45, which causes high pressure water delivered by the water pump to be delivered to the nozzles for producing a vigorous cleaning action to the tank.

The nozzle tube 140 can also function as a structural member to assist in securing the door in its closed position. Specifically, the nozzle tube includes a threaded male portion 142 (FIG. 3) on the end thereof adjacent the back door 124 of the collection tank. When the door is to be shut, and the collection tank sealed, a screw-down type handle 146 mounted in the door is turned, and the screw-down handle includes an outwardly projecting threaded female portion 148 (FIG. 3) which mates with the male portion as the handle is turned, thus tightly pulling the door to the open rim 150 of the collection tank, thereby sealing the tank. Actuation of the vacuum pump further assists the sealing of the door against the tank opening. The door also includes a sight glass 152 to allow visual observation of the interior of the tank.

The system 10 includes a hydraulic system for operating the hydraulic cylinders 132. The hydraulic system can also serve as a source of hydraulic pressure for operating hydraulic tools that may be used with the system 10. Referring to FIG. 4, the hydraulic system includes a hydraulic pump 168 that is operably driven by the motor M. Hydraulic fluid is supplied to the pump from a reservoir 170. The output 171 of the hydraulic pump 168 is connected to the inlets 173 of the hydraulic cylinders 132 by a supply line 175. The outlets 177 of the hydraulic cylinders are connected to the reservoir 170 by a return line 179. A filter 182 is connected in the return line 183 for filtering the hydraulic fluid before it returns to the reservoir. A control valve 172 is connected in the supply line for controlling the delivery of hydraulic fluid to the cylinders. The control valve 172 may be manually operated, e.g., by a lever. Alternatively, the control valve 172 may, for example, be an electro-mechanical valve, in which case the valve may be operated from the control panel 200, for example.

To use the vacuum and reduction system 10, water is added to water tank W, and the valve 34 is opened to allow water flow to the water pump. The motor M is powered up, and water pressure is allowed to build in the system. The reduction tool R is connected to the collection tank C with the vacuum hose 62, and water line 184 is also connected to the reduction tool. A hose reel 188 is provided for paying out water line 184 to the reduction tool during use.

As the tool R is used, it is pressed downwardly into the ground in order to dig a hole. For larger diameter holes, the tool R is moved in a generally circular manner as it is pressed downwardly. Slurry will begin to accumulate in the collection tank C as the tool R is used. Once the job is finished, or when the collection tank is full, the engine is set to a low idle to maintain a vacuum in the tank. This allows the door handle to be turned such that the female threaded member is no longer in threading engagement with the male member, the vacuum pressure continuing to hold the door closed. The engine can then be shut down and then air enters the tank through the vacuum pump or other openings, thereby pressurizing the tank and allowing the door to be opened.

A control panel 200 is provided for controlling operation of various components within the system 200, such as the motor M. The control panel may also control operation of the various valves in the system and include gages for monitoring various operating parameters, such as vacuum and water pressure. The system may also include lights 202 for use at night or in low light conditions. An auxiliary spray wand 204 is provided, which can be attached to high pressure water line (not shown), e.g., for localized cleaning of tank C or other items.

Figure 5:
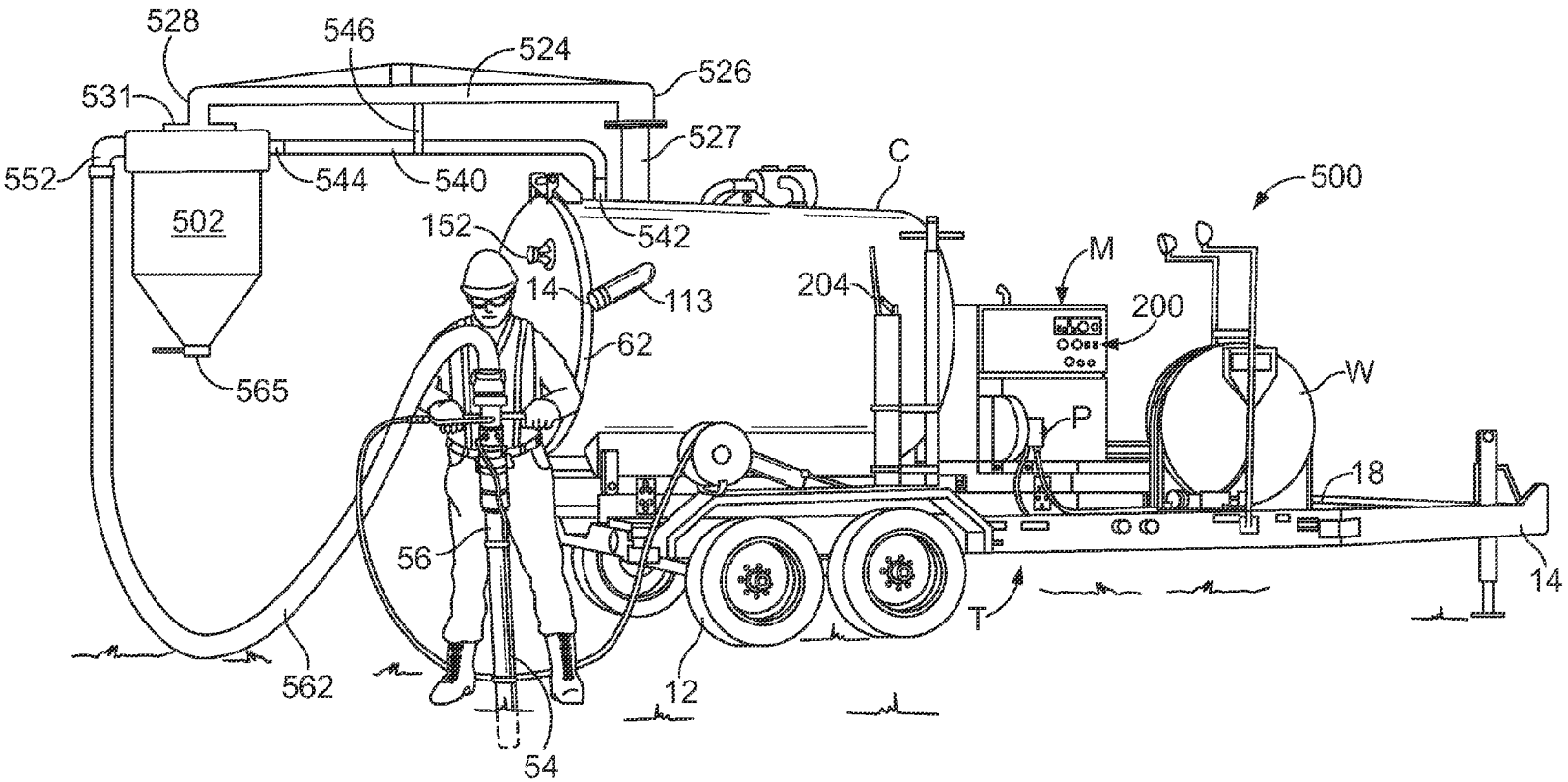
FIG. 5 is a perspective view of an embodiment of a mobile vacuum system according to certain aspects of the present invention.
Figure 6:
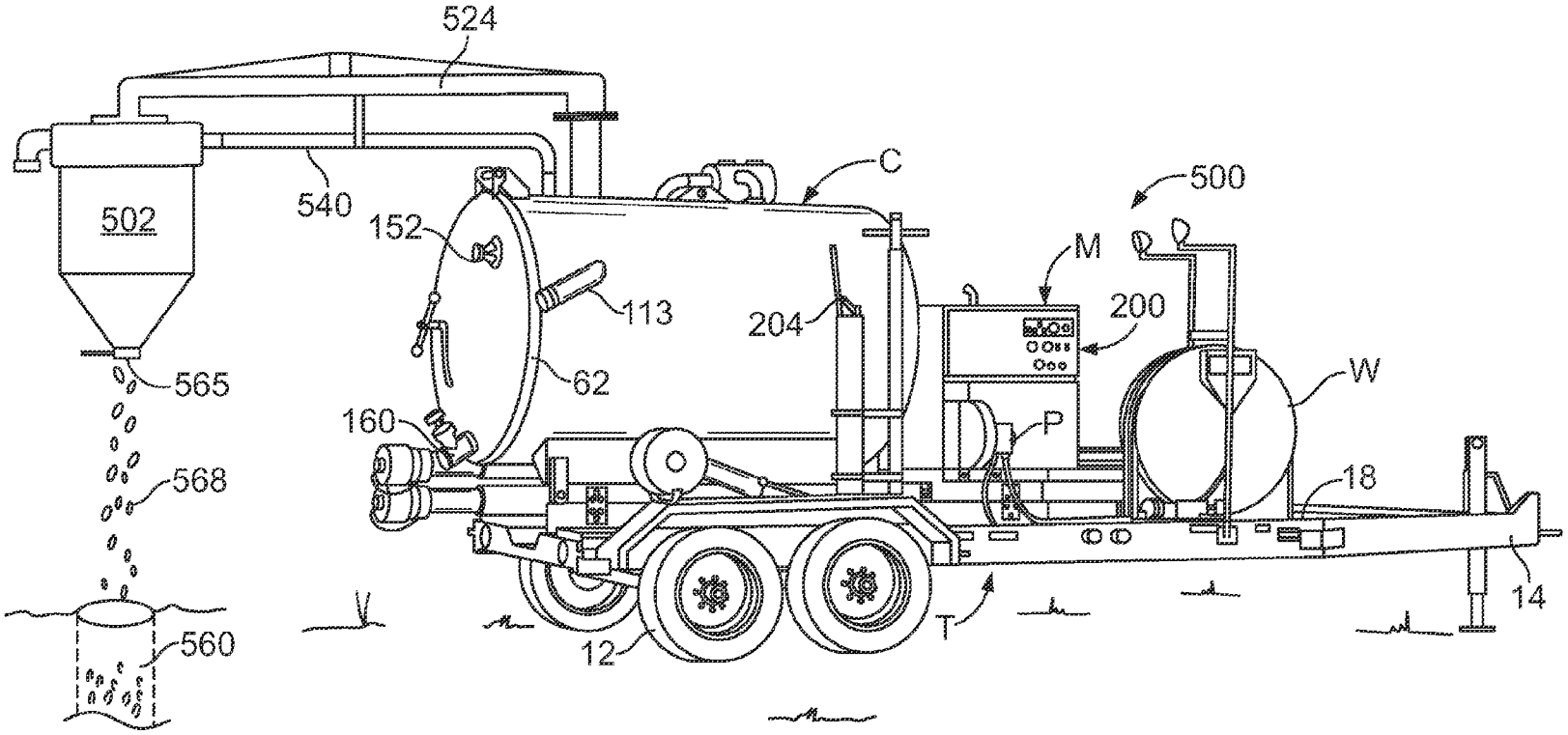
FIG. 6 is a further perspective view of the system of FIG. 5, illustrating contents being dumped from a secondary debris tank.
Figure 7:
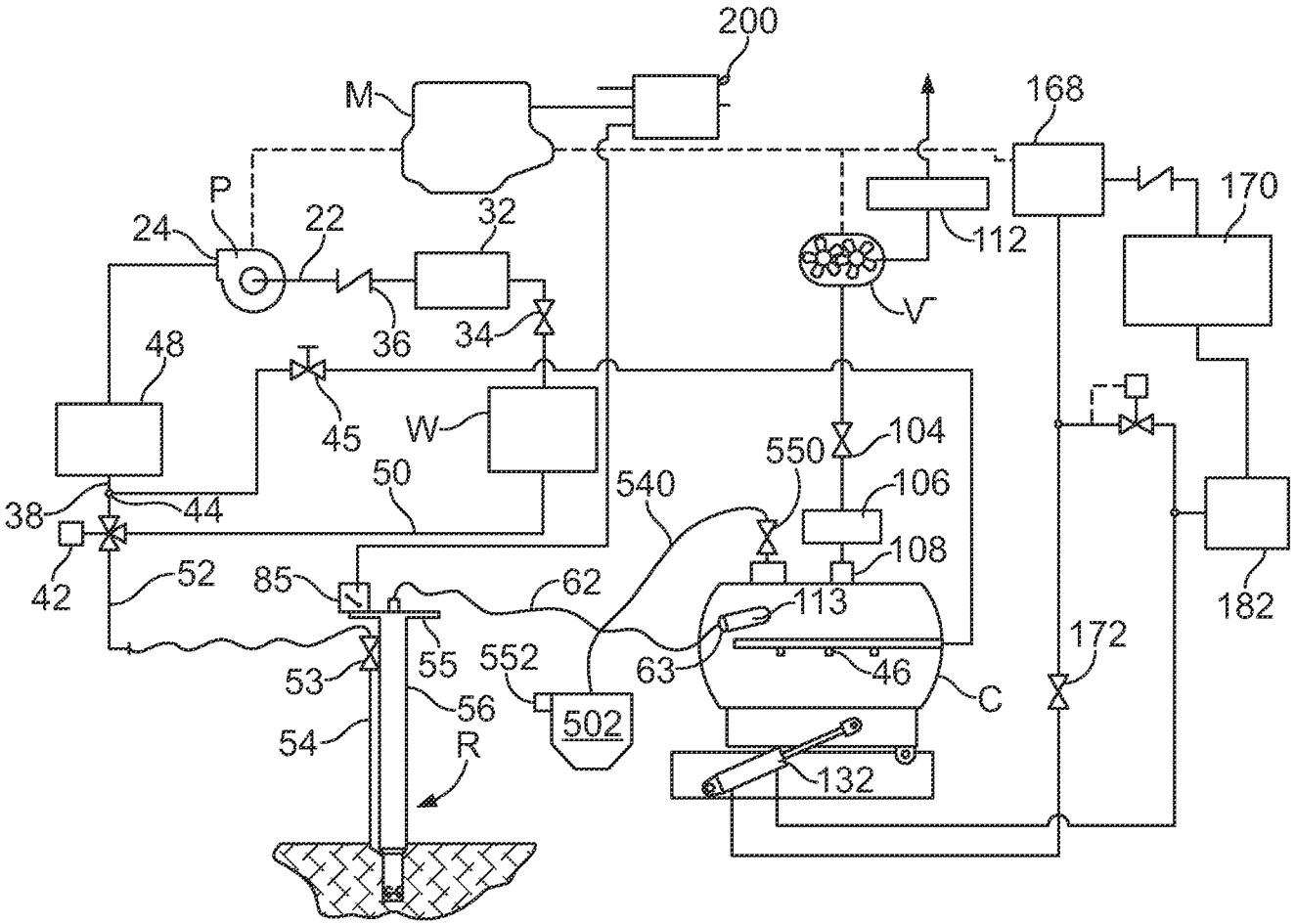
FIG. 7 is a schematic illustration of the hydraulic, water, and vacuum systems of the embodiment of FIGS. 5-6.
Figure 11A:
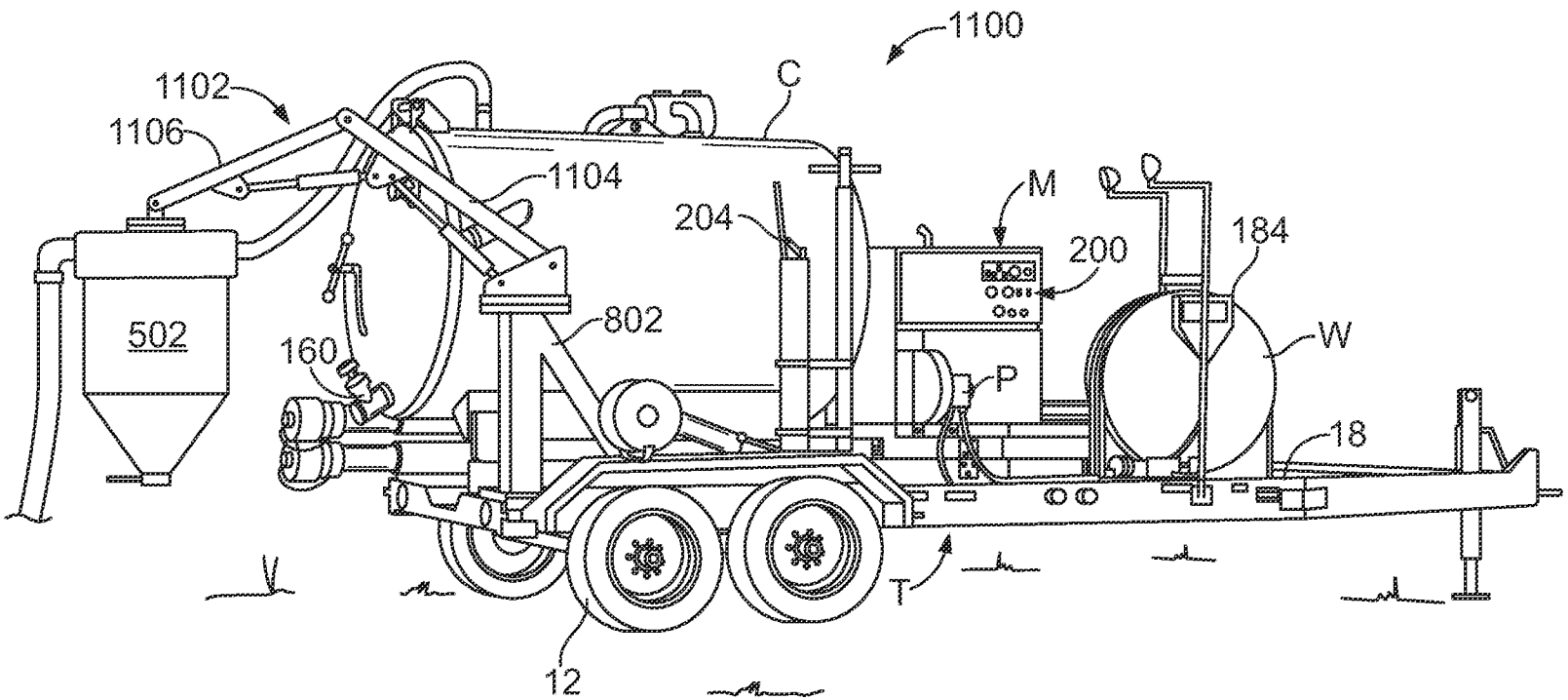
FIGS. 11A and 11B illustrate another embodiment of a mobile vacuum system according to certain aspects of the present invention.
Figure 11B:
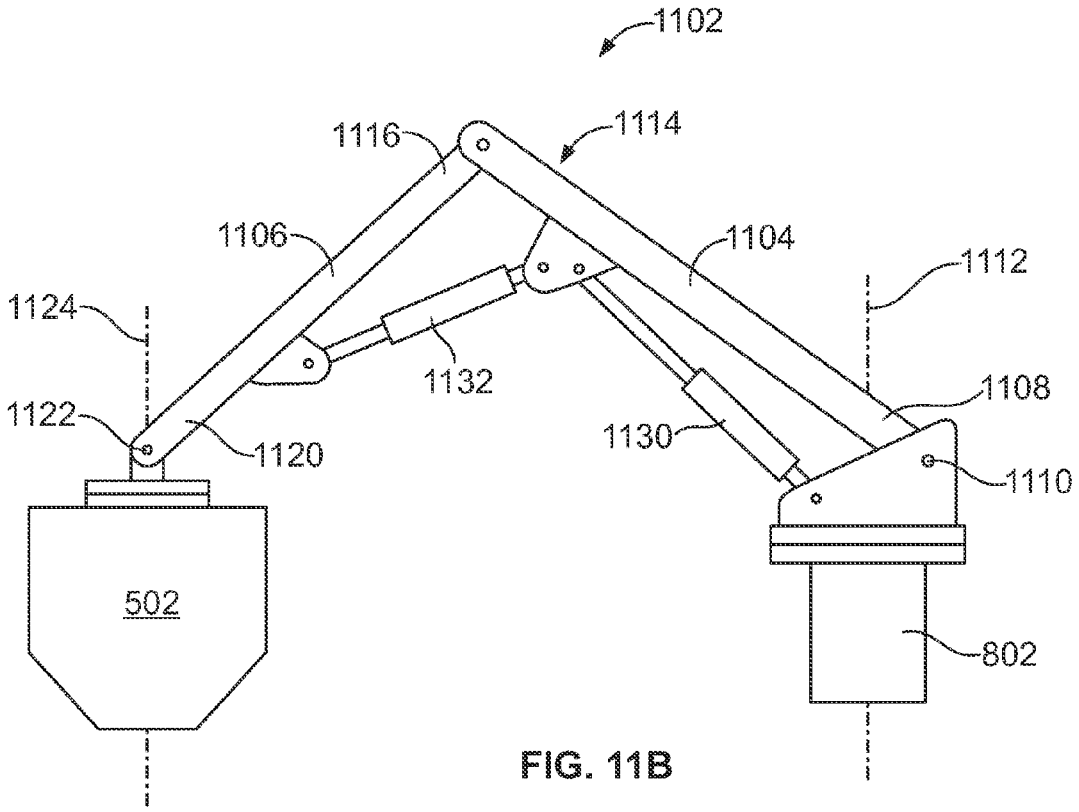

Referring now to FIGS. 5-7, an embodiment of a mobile vacuum 500 according to certain aspects of the present invention will be described. The system 500 of FIGS. 5-7 uses many of the same components as the system 100 of FIGS. 1-4. Accordingly, the same reference numerals are used to designate like components. The system 500 of FIGS. 5-7 differs from that of FIGS. 1-4 in that it includes both the primary collection tank C and a secondary collection tank 502, which is movable relative to the trailer T and the (primary) collection tank C. In this regard, the system 500 includes a boom 524 having a first end 526 movably connected relative to the primary tank C and a second end 528 connected to a secondary tank 502. In the embodiment of FIGS. 5-7, the first end of the boom 524 is pivotally coupled to a mounting bracket 527 carried by the collection tank C, whereas in FIGS. 8-9, the boom pivots about a mount that extends upwardly from the trailer T, as described below. The boom 524 allows the secondary tank 502 to be rotated laterally around the trailer T. In a preferred embodiment, the boom 524 can be rotated along an arc of approximately 270 degrees around the trailer T. A rotational coupling 531 can be used to connect the secondary tank 502 to the boom 524 to allow the tank to rotate relative to the second end of the boom 524. While the boom 524 is shown as having a single arm, it will be appreciate that the boom could comprise multiple articulating arms (e.g., as shown in FIGS. 11A and 11B) to facilitate more precise movement of the secondary tank 502 relative to the trailer.

A suction conduit 540 has one end coupled to a second suction port 542 of the primary tank C and a second end coupled to an outlet port 544 on the secondary tank 502. The suction conduit 540 may be connected to the boom 524, e.g., by hangers 546, to support the suction conduit relative to the boom. A valve 550 (see FIG. 7) is provided for controllably coupling the secondary tank 502 to the main tank through the conduit 540. The 550 valve can be located, for example, at the second suction port 542 of the primary tank C or at the outlet port 544 of the secondary tank 544. To use the secondary tank 502, the valves 63 and 550 are manipulated to close the main tank's first suction port 113 and open its second suction port 542, respectively. With the valves 63 and 550 so configured and the vacuum pump V operating, a positive vacuum is created at the suction port 552 of the secondary tank 436. As the vacuum draws air is drawn through the secondary tank 502 a venturi forms trapping debris in the secondary tank 502.

Figure 8:
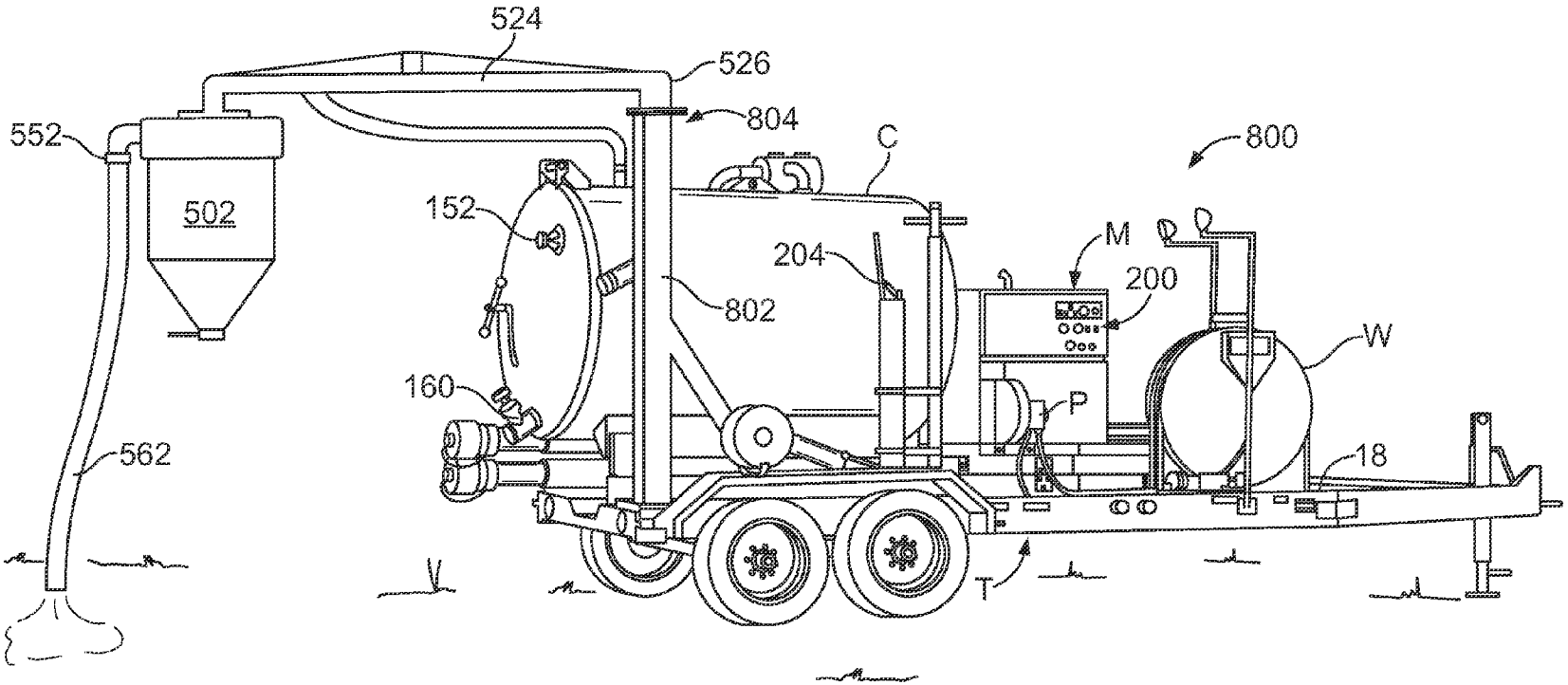
FIG. 8 is a perspective view of another embodiment of a mobile vacuum according to certain aspects of the present invention.

The suction port 552 can be connected to a suction hose 562. The hose 562 in turn may be connected to tool R as shown in FIG. 5 to allow the tool to be used to vacuum materials. Alternatively, the hose 562 (or a vacuum wand/tool) may be used in lieu of the tool R, as is shown in FIG. 8.

The secondary tank 502 includes an outlet 565 that can be opened to dump debris 568 out of the secondary tank. For example, as shown in FIG. 6, the secondary tank 502 can be positioned over a hole 560 to back fill the hole with debris contained in the tank.

In the illustrated embodiment, the secondary tank is coupled to the vacuum pump V through the primary tank C. As a result, any debris that is not captured by the secondary tank is advantageously captured by the primary tank C. Alternatively, in some embodiments it may be desirable to couple the secondary tank directly to the vacuum V.

A mobile vacuum system as described herein has several advantages including the following:

- Allows for wet and dry collection of debris in two separate areas on one machine. Dry material can be collected in the secondary tank and wet material collected in the main tank or vice versa.
- The secondary tank can be pivoted around the trailer with extended reach to facilitate debris collection and dumping. The secondary tank can be precisely positioned over a hole to back fill it with debris contained in the tank, thereby eliminating the need to move the trailer or manually transport the debris to the hole, e.g., with a wheelbarrow.
- The pivot arm acts as a support for the suction hose and allows for easier use by supporting the weight of the hose.

Figure 9:
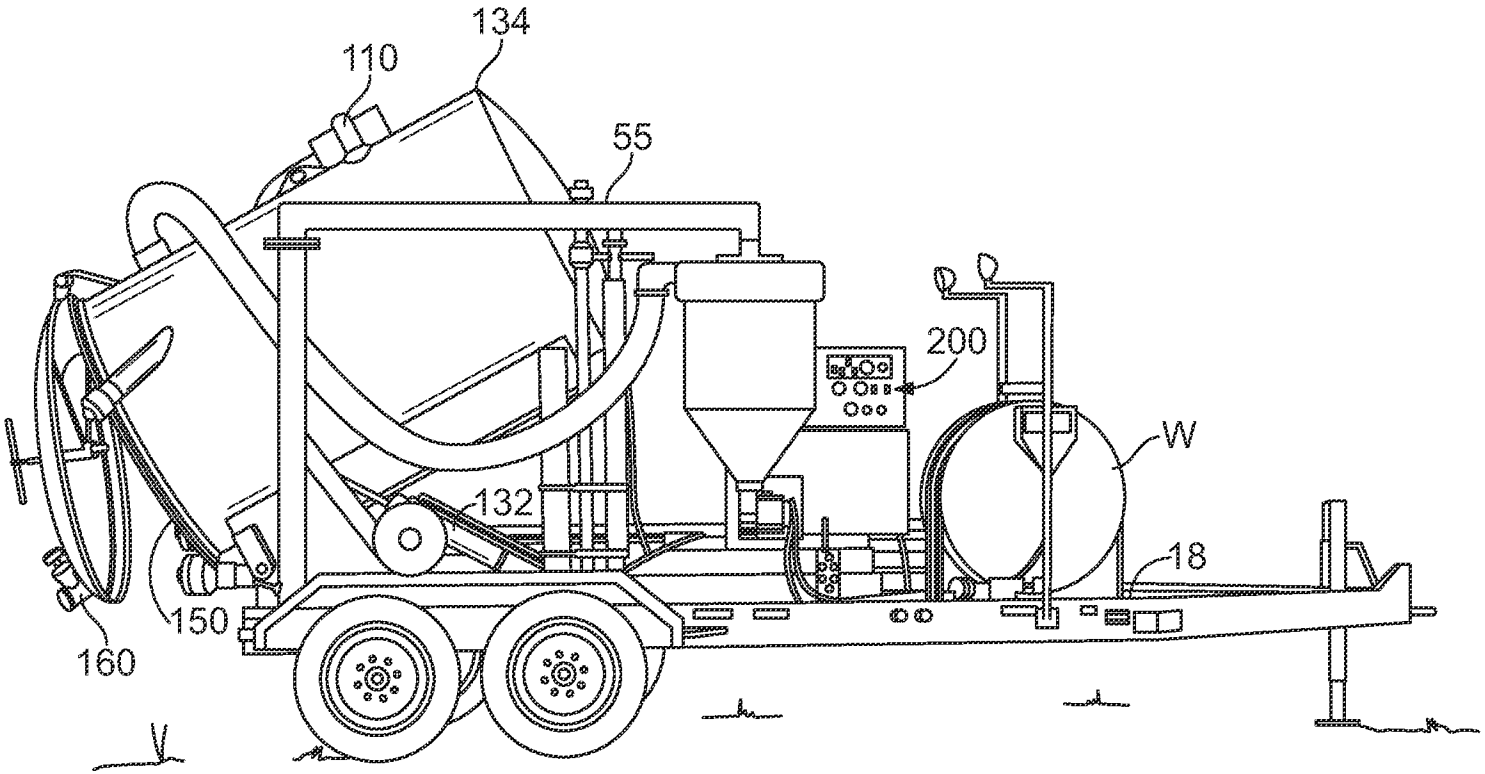
FIG. 9 is a side elevation view of the system of FIG. 7, where the primary tank in its inclined and the secondary tank in its stowed position.

FIGS. 8-9 illustrate a second embodiment 800 of a mobile vacuum with remote debris tank. The systems illustrated in FIG. 7 are the same for the embodiment of FIGS. 8-9. The embodiment 800 of FIGS. 8-9 differs from that of FIGS. 5-7, in that the boom 524 is movably mounted to the trailer T instead of the primary tank C. For this purpose, a mounting bracket 802 is connected to and extends upwardly from the trailer T. The first end 526 of the boom 524 is rotatably coupled to the upper end 804 of the mounting bracket 802 to permit the boom (and the secondary tank) to rotate relative to the trailer. As shown in FIG. 7, the upper end 804 of the mounting bracket 802 preferably extends above the top of the primary tank C to permit the boom to rotate over the top of the tank. Advantageously, this second embodiment 800 allows the main tank C to be tilted (for dumping) independently of the secondary tank 502. In particular, as is shown in FIG. 8, the secondary 502 tank can be rotated towards the front of the trailer T so that the primary tank C can be included for dumping. The secondary tank 502 can also be moved to this location for storage, e.g., during transport.

Figure 10:
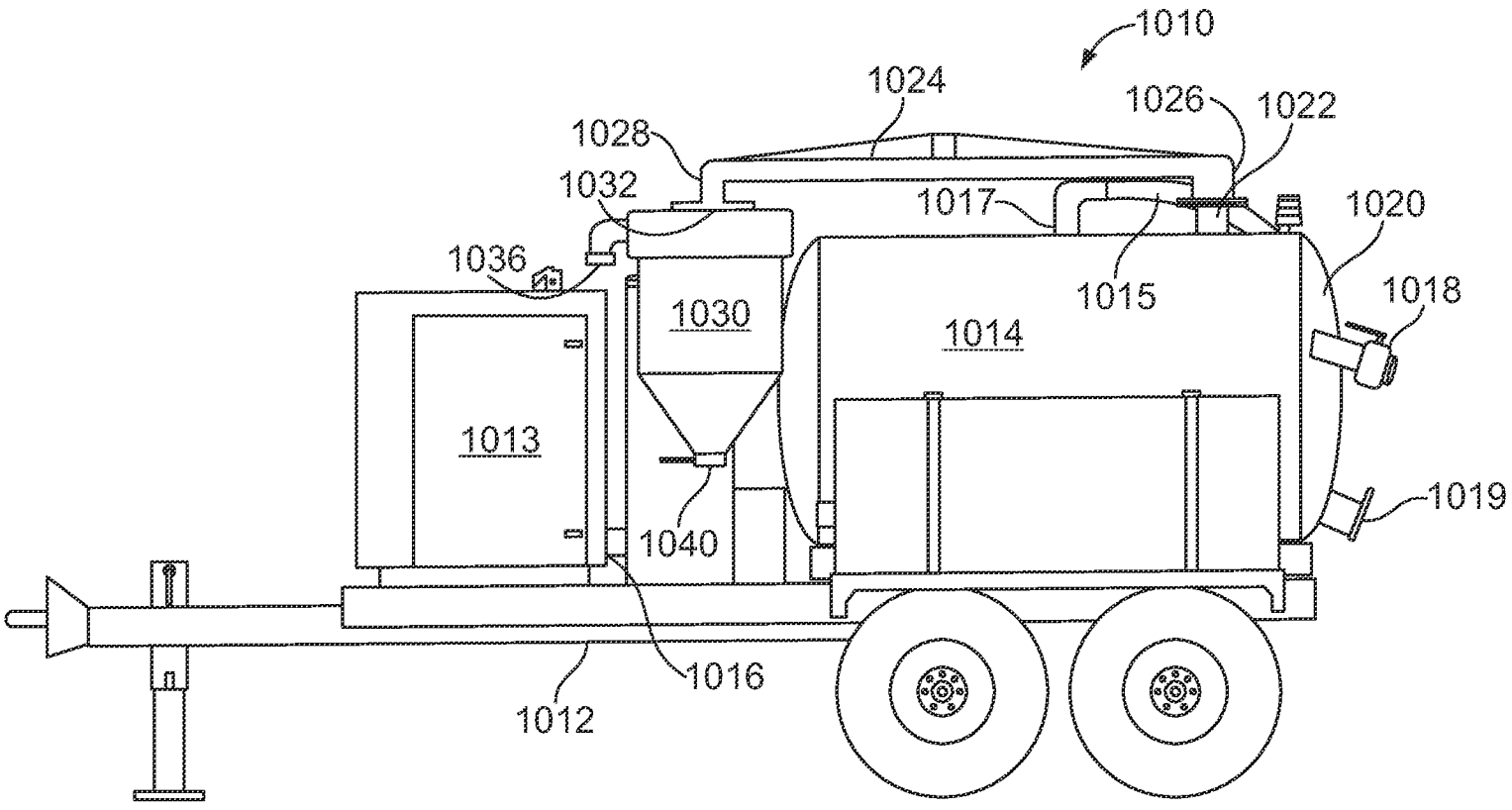
FIG. 10 illustrates another embodiment of a mobile vacuum system according to certain aspects of the present invention.

FIG. 10 illustrates a mobile vacuum system 1010 according to another embodiment of the present invention. By way of non-limiting example, the mobile vacuum system may constructed using an LP 550 series as manufactured by Vac-Tron Equipment, LLC of Okahumpka Fla. The LP 550 may be modified, as explained below, to include a remote debris tank 1030.

The system 1010 includes a wheeled trailer 1012 for carrying the other components of the system. While a trailer mounted system is shown, it will be appreciated that the system could be carried by a truck or railcar, for example. The system 1010 includes a vacuum creating device 1013 which preferably includes a vacuum pump (not shown) operatively driven by an engine (not shown), such as a diesel engine. The vacuum pump is coupled to primary debris tank 1014 for creating a positive vacuum to draw debris into the primary tank. For this purpose, a conduit 1015, such as a flexible tube, has one end 1016 coupled to the vacuum pump and its other end 1017 coupled to the main tank 1014. The main tank includes a first suction port 1018, which includes a valve (not shown) for opening and closing the port 1018. The valve in the suction port maybe manually operated, e.g., using a handle. Alternatively, the valve may be in the form of a solenoid actuated valve, for example, to permit the valve to be actuated from a control panel. A suction hose (not shown) can be coupled to the suction port 1018 and the distal end of the suction hose can be manually positioned by an individual to suck debris into the primary tank. The main tank 1014 also includes a discharge port 1019 that can be used to discharge liquids from the primary tank 14. The primary tank 414 can also include a hinged rear hatch or door 1020 that can be opened to remove debris from the main tank. The main tank can be pivot upwardly in a manner similar to a dump truck, e.g., by hydraulic cylinders (not shown). With the main tank 1014 so inclined and the hatch 1020 open, debris flows from the tank under the force of gravity.

The aforementioned LP 555 may be modified to incorporate a remote debris tank 1030 in accordance with certain aspects of the present invention. In this regard, the primary tank also includes a second suction port 1022. A boom 1024 has a first end 1026 pivotally connected to the main tank 1014 at the second suction port 1022 and a second end 1028 connected to the secondary tank 1030. The boom 1024 can be pivoted to move the secondary tank 1030 laterally around the trailer 1012. The boom 1024 carries a suction conduit (not shown) that has one end operably coupled to the second suction port 1022 of the main tank and a second end operably coupled to an upper port 1032 on the secondary tank 1030. The secondary tank 1030 further includes a suction port 1036 that can be connected to a suction hose (not shown). Valving is provided for operably coupling the secondary tank to the main tank. The valving can be located, for example, at the second suction port 1022 of the main tank 414 or at the port 1032 of the secondary tank 1030. To use the secondary tank 1030, the valves are manipulated to close the main tank's first suction port 1018 and open its second suction port 1022. With the valves so configured and the vacuum operating, a positive vacuum is created at the inlet port 1036 of the secondary tank 1030. As the vacuum draws air is drawn through the secondary tank 1030 a venturi forms trapping debris in the secondary tank 1030. An outlet 1040 at the bottom of the secondary tank 1030 can be opened to dump debris out of the secondary tank.

FIGS. 11A and 11B illustrate a mobile vacuum system 1100 according to another embodiment of the present invention. The embodiment of FIGS. 11A and 11B is similar to that of FIG. 8, except that the boom comprises an articulating arm 1102. Also, although not necessary, the mounting bracket 802 is somewhat shorter in FIG. 11A than in FIG. 8. The articulating arm 1102 includes first and second members 1104, 1106. The first member 1104 has its first end 1108 movably coupled to the upper end of the mounting bracket 802. Preferably the first member 1104 is coupled to the mounting bracket 802 so that it can rotate (or pivot) about at least two axis, e.g., a first (horizontal) axis 1110 and a second (vertical) axis 1112, relative to the mounting bracket 802 (and hence the trailer T.) The second end 1114 of the first member 1104 is rotatably coupled to the first end 1116 of the second member 1106. The second member 1106 has its second end 1120 movably coupled to the upper end of the secondary tank 502 so the tank can move about at least one axis relative to the second arm. Preferably, the second arm 1106 is coupled to the secondary container 502 to allow the secondary container to move about at least two axes 1122 and 1124 relative to the second member 904. A first biasing member 1130 can be connected between the first member 1104 and the mounting bracket 1102 for controlling movement of the first member 1104 about the first axis 1110. Likewise, a second biasing member can be connected between the first and second member 1104, 1106 for moving the second member 1106 relative to the first member 1104. The first and second biasing members 1130, 1132 preferably comprise hydraulic cylinders. The hydraulic cylinders may be coupled to the hydraulic system (discussed above) and controlled in a conventional manner.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

The invention claimed is:

1. A mobile vacuum system comprising:

a mobile support frame;

a primary collection tank mounted to the mobile support frame, the primary collection tank including an inlet port;

a vertical post having a top end and a bottom end, the bottom end connected to and extends upwardly from the mobile support frame and separate from the primary collection tank;

a horizontal boom having a first end and a second end, the first end being rotatably coupled to the top end of the vertical post and the second end cantilevered out from the top end of the vertical post;

a secondary collection tank having a top surface connected directly to the second end of the horizontal boom and the secondary collection tank suspended from the second end of the horizontal boom by its top surface and configured for rotation relative to the primary collection tank, the top end of the vertical post extending above a top of the primary collection tank and configured for the horizontal boom to rotate over the top of the primary collection tank;

the secondary collection tank including a suction port and an outlet port, wherein the secondary collection tank is configured so that debris is vacuumed into the secondary tank through the suction port and into a bottom of the secondary collection tank as air is drawn out through the outlet port to the inlet port of the primary collection tank; and a vacuum source carried by the mobile support frame in fluid communication with the primary collection tank.

2. The mobile vacuum system of claim 1, further comprising a vacuum hose configured to be secured directly to either the suction port of the secondary collection tank or the inlet port of the primary collection tank, wherein the secondary collection tank is bypassed when the vacuum hose is secured directly to the inlet port of the primary collection tank.

3. The mobile vacuum system of claim 2, the secondary collection tank further comprising an outlet valve disposed proximate a bottom of the secondary collection tank, wherein the outlet valve is configured to be opened to drop out the debris from the secondary collection tank to a desired location after positioning the secondary collection tank using the horizontal boom.

4. The mobile vacuum system of claim 1, further comprising a vacuum hose carried by the horizontal boom.

* * * * *